United States Patent [19]

Miura et al.

[11] Patent Number: 4,770,602

[45] Date of Patent: Sep. 13, 1988

[54] METHOD OF CAPACITY CONTROLLING OF MULTISTAGE COMPRESSOR AND APPARATUS THEREFOR

[75] Inventors: Haruo Miura; Toshio Kaneko; Yoshiaki Abe; Hiroshi Ohmachi, all of Ibaraki, Japan

[73] Assignee: Hitachi, Ltd., Tokyo, Japan

[21] Appl. No.: 941,639

[22] Filed: Dec. 15, 1986

Related U.S. Application Data

[63] Continuation of Ser. No. 624,038, Jun. 25, 1984, abandoned.

[30] Foreign Application Priority Data

Jun. 29, 1983 [JP] Japan ..... 58-115815

[51] Int. Cl.[4] ..... F01D 17/00

[52] U.S. Cl. ..... 415/29; 415/1

[58] Field of Search ..... 415/1, 17, 29

[56] References Cited

U.S. PATENT DOCUMENTS 3,603,695 9/1971 Yokota ..... 415/17
3,723,018 3/1973 Uchiyama et al. ..... 415/17
4,288,198 9/1981 Hibino et al. ..... 415/17
4,303,372 12/1981 Caffrey ..... 415/1
4,431,371 2/1984 Thomson ..... 415/116

*Primary Examiner*—Robert E. Garrett
*Assistant Examiner*—John T. Kwon
*Attorney, Agent, or Firm*—Antonelli, Terry & Wands

[57] ABSTRACT

The invention relates to a capacity control method for controlling the capacity of a multistage compressor in response to a flow rate signal by varying the openings of vanes at individual stages. The relationships of the openings of the vanes of the individual stages are made to vary in response to the flow rate signal from the multistage compressor. Thus, when the flow rate of the multistage compressor is far from the anti-surge capacity within the operable range thereof, it is possible to select vane opening relationships which provide the highest efficiency for the multistage compressor. When the flow rate of the multistage compressor drops to either a value near the anti-surge capacity or the inoperable range, on the other hand, it is possible to select vane opening relationships which provide an enlargement of the operating range of the multistage compressor, before the flow rate enters that inoperable range.

8 Claims, 4 Drawing Sheets

METHOD OF CAPACITY CONTROLLING OF MULTISTAGE COMPRESSOR AND APPARATUS THEREFOR

This is a continuation of application Ser. No. 624,038 filed June 25, 1984, now abandoned.

BACKGROUND OF THE INVENTION

The present invention relates to capacity control and, more particularly, to a capacity-controlling method and apparatus which are suitable for a compressor such as a multistage centrifugal compressor which has coolers between the stages thereof, or an axial-centrifugal compressor which has coolers between an axial compression stage and a centrifugal compression stage.

In, for example, a multistage centrifugal compressor, capacity control is performed by providing vanes at the entrances of individual stages and operating the vanes, with a typical system being proposed in U.S. Pat. No. 4,288,198. In this proposed control method, the vanes of each of a plurality of stages are moved experimentally to confirm changes in efficiency, so that the efficiency peak can be found for each.

However, with this method, the relationships of the vane openings of each of the stages are mechanically fixed in advance as linear relationships. In other words, the vane openings of the individual stages are determined independently of the flow rate of the compressor, so that the vane opening of a downstream stage is linearly determined once the vane opening of the first stage has been determined.

The individual stages of a multistage compressor have intrinsic, different fluid performances, so that its overall performance is determined by a combination of different performances. In a conventional linear combination of individual vane openings, e.g., in an air separation plant, the turn-down capacity is technically acceptable at about 70% of the rated capacity, and higher efficiencies are expected within that range. The recent energy-saving trend has led to a demand for a further enlargement of the control range and higher efficiencies when partially-loaded. In the prior art, however, as noted, above these demands cannot be satisfied because the relationships of the vane openings at individual stages are fixed.

SUMMARY OF THE INVENTION

It is, therefore, an object of the present invention to provide a method of controlling the capacity of a multistage compressor, which enables an enlargement of the control range and an increased efficiency when partially loaded, and an apparatus therefor.

Another object of the present invention is to provide a method of controlling the capacity of a multistage compressor, and an apparatus therefor, which can provide the highest efficiency for the multistage compressor, when the flow rate in the multistage compressor is far from the anti-surge capacity thereof, i.e., within the operable range of the multistage compressor; and enlarge the operating range of the multistage compressor before the multistage compressor enters the inoperable range, when the capacity of the multistage compressor is near the anti-surge capacity or is brought into the inoperable range as a result of a decrease in its flow rate.

In order to achieve those objects, the present invention is constructed so that the relationships of vane openings of individual stages can be varied when the capacity is being controlled by varying the vane openings in accordance with a flow rate signal from the multistage compressor.

Because of this construction, vane opening relationships providing the highest efficiency for the multistage compressor can be selected when the flow rate of the multistage compressor is far from the anti-surge capacity within the operable range. When the flow rate of the multistage compressor is reduced to either a value near the anti-surge capacity or into the inoperable range, on the other hand, it is possible to select vane opening relationships effecting an enlargement of the operating range of the multistage compressor, before the flow rate enters that inoperable range.

BRIEF DESCRIPTION OF THE DRAWINGS

Other objects of the present invention will become apparent from the following description with reference to the accompanying drawings, in which.

DETAILED DESCRIPTION

The present invention will now be described in connection with embodiments thereof, with reference to FIGS. 1 to 7.

Figure 1:
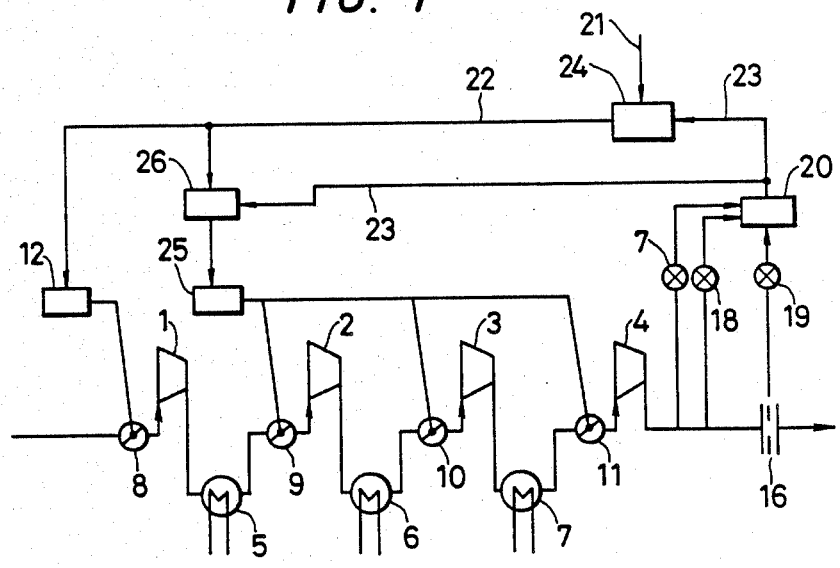
FIG. 1 is a schematic view of an embodiment of the present invention.

Referring now to the drawings wherein like reference numerals are used throughout the various views to designate like parts and, more particularly, to FIG. 1 according to this figure, a multistage compressor in which the capacity is controlled by controlling the openings of vanes of a plurality of stages is provided with compressors 1–4 each constituting a stage. Coolers 5 to 7 are interposed between adjacent pair of stages, and an entrance or inlet to each stage is respectively provided with inlet guide vanes 8 to 11. The first-stage inlet vanes 8 are driven by a first-stage vane driver 12, and the second-to fourth-stage inlet vanes 9 to 11 are each driven by a following-stage group vane driver 25. The vane drivers are devices which convert an opening instruction signal 22 from a controller 24 into a mechanical force for driving the vanes.

The flow rate of the multistage compressor thus constructed is metered in terms of the pressure difference, inlet temperature, and inlet pressure at a discharge orifice 16. These values are converted by respective converters 19, 17 and 18 into electric signals which are converted into the compressor flow rate (i.e., the metered flow rate) by a computer 20. The thus obtained flow rate signal 23 is fed back to the controller 24. Specifically, a target flow rate signal 21 for the compressor given to the controller 24, from which the vane-operating instruction signal 22 instructs both the vane drivers 12 and 25 in a manner that they eliminate the difference thereof from the flow rate signal 23 fed back, to control the capacity of the compressor.

Between the controller 24 and the following-stage group driver 25, a proportion-setting unit 26 is connected to which the flow rate signal 23 is input. This proportion-setting unit 26 may be of either an analog or a digital type and has the following functions. (1) If the opening of the first-stage vanes is designated by B and the opening of the following-stage group of vanes by A, the signal corresponding to the first-stage vane opening B is inputted from the vane-operating instruction signal 22 so that a value prepared by multiplying the degree of opening by a constant ($\alpha$) and adding a constant ($\beta$) to the value obtained is output to the following-stage group vane driver 25. (2) In this case, the proportion-setting unit 26 compares the flow rate signal 23, i.e., the flow rate, with the anti-surge capacity of the compressor and executes function (1) if the flow rate is within the anti-surge capacity. (3) If the flow rate is outside the anti-surge capacity, the proportion-setting unit 26 changes the values ($\alpha$) and ($\beta$) in proportion to the flow rate, and execute, function (1).

Figure 6:
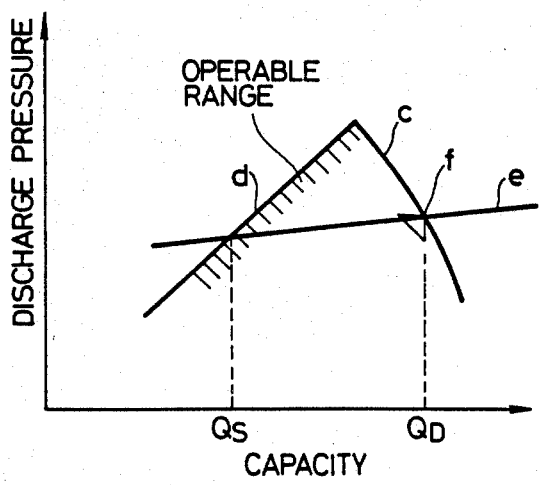
FIG. 6 is a graphical illustration of relationships between performance curves and an operating line of the compressor, according to the prior-art.

The operations of the present invention will now be explained in comparison with those of a prior-art method. In this prior-art method, if the actual compressor flow rate 23 is far from the target flow rate 21, the vane-operating instruction signal 22 is output to operate the vanes until the compressor flow rate reaches the target flow rate value 21. During this time, the relationship between the openings of the first-stage vanes and the following-stage group of vanes are fixed, as indicated by the curves a and b in FIG. 5. If the opening relationship is set at a or b when the compressor is fabricated, more specifically, the operating performance of the compressor is fixed because that relationship cannot be varied. FIG. 6 shows the relationship between the performance curve and the operating line of the compressor in the capacity-controlling operation of the prior art. In FIG. 6, the curve c is the performance line of the compressor, the curve d is the surge line, and the curve e is the plant operation line. The range within which the compressor can operate is defined by the rated capacity $Q_D$ at the design point (f) and by the capacity $Q_S$ at which the plant operation line (e) and the surge line (d) cross. The defined range is technically expressed as about 0.7 of the ratio of $Q_S/Q_D$ for an air separation plant. This value of 0.7 is an experimental value which is obtained, when the capacity control is conducted by the prior-art method, for the two demands that the efficiency in the turn-down capacity is as high as possible and the control range is as wide as possible.

The present invention provides a capacity control which enables both an excellent high efficiency when partially loaded and a wide control range, which cannot be realized by the prior art. The present invention is constructed such that the relationships between the inlet guide vanes of the first stage and those of the following-stage group can be combined in different manners according to the flow rate of the multistage compressor. In other words, the gradient ($\alpha$) and the intercept ($\beta$) of the line governing the following-stage vanes with respect to the first-stage vanes can be varied linked to the flow rate signal 23 (i.e., the flow rate of the compressor), as expressed by the following Equations (1) and (2):

$$\alpha = f(Q) \quad (1)$$

$$\beta = f(Q) \quad (2)$$

where $\alpha$: the gradient (deg/deg.) of the line of the following-stage vane opening with respect to the first-stage vane opening, $\beta$: the intercept of the line of the following-stage vane opening with respect to the first-stage vane opening, and Q: the compressor flow rate (N $m^3$/Hr.).

Figure 7:
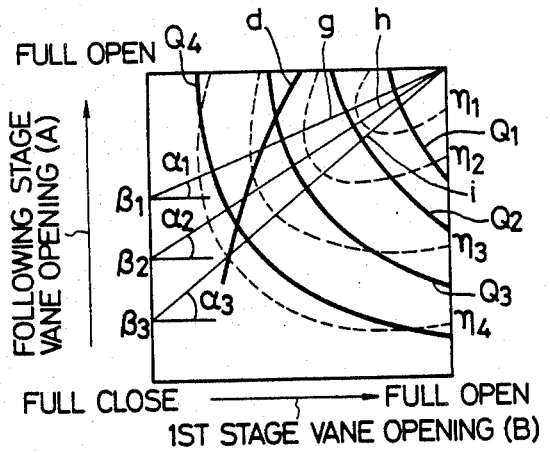
FIG. 7 is a graphical illustration corresponding to FIG. 5, which illustrates the vane opening relationships according to the present invention.

The behaviors of the openings of the first-stage vanes and the following-stage group of vanes will be described with reference to FIG. 7 showing the vane openings, in which the following-stage group vane openings A are plotted against the first-stage vane opening B. In FIG. 7, the curve d is the surge line of the multistage compressor which divides the operable range on the righthand side thereof from the inoperable range on the lefthand side thereof. Curves $\eta_1$ to $\eta_4$ are equi-efficiency lines which are drawn by determining the efficiencies of the multistage compressor with different combinations of the first-stage vane openings and the final-stage vane openings. Curves $Q_1$ to $Q_4$ are equi-flow lines which are drawn in a similar manner. The opening relationship for the flow rate $Q_1$ is indicated by the straight line g which has a gradient $\alpha_1$ and an intercept $\beta_1$. When the flow rate is varied to $Q_2$ and $Q_3$, the gradient and intercept thereof change to $\alpha_2$, $\alpha_3$, $\beta_2$ and $\beta_3$, respectively, to provide the straight lines h and i.

Figure 8:
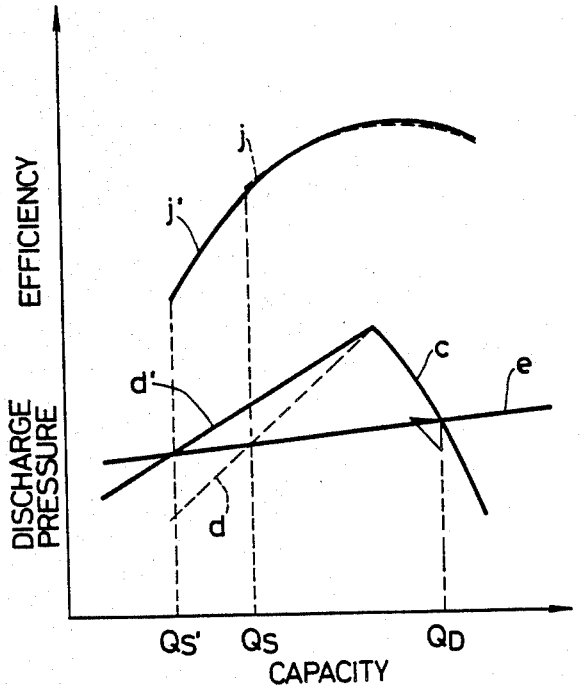
FIG. 8 is a graphical illustration corresponding to FIG. 6, which illustrates the relationship between the performance curves and the operating line of the compressor according to the present invention.

For a flow rate which sufficiently varies from the surge line, it is possible to select a vane opening relationship which provides the highest efficiency. Near the surge line, the surge line can be shifted toward the lower flow rate side by varying the vane opening relationship in response to the flow rate signal. If the embodiment of FIG. 1, for example, is applied to an air separation plant, the control range of the prior art can be increased, as shown in FIG. 8, and the highest operational efficiency can be realized at an operating point far from the surge flow rate, by setting the intercept $\beta$ at a high level and the gradient $\alpha$ at a low level for a flow rate far from the surge line, and by setting the intercept $\beta$ at a low level and the gradient $\alpha$ at a high level for a flow rate close to the surge line (e.g., close to or below the capacity $Q_S$ of the prior art). The performance of the present invention is indicated by the dashed characters in FIG. 8, in which the curve d corresponds to the combination of a low $\alpha$ and a high $\beta$, whereas, the curve d' corresponds to a combination of a high $\alpha$ and a low $\beta$. Incidentally, the letter j indicates the efficiency line.

Figure 2:
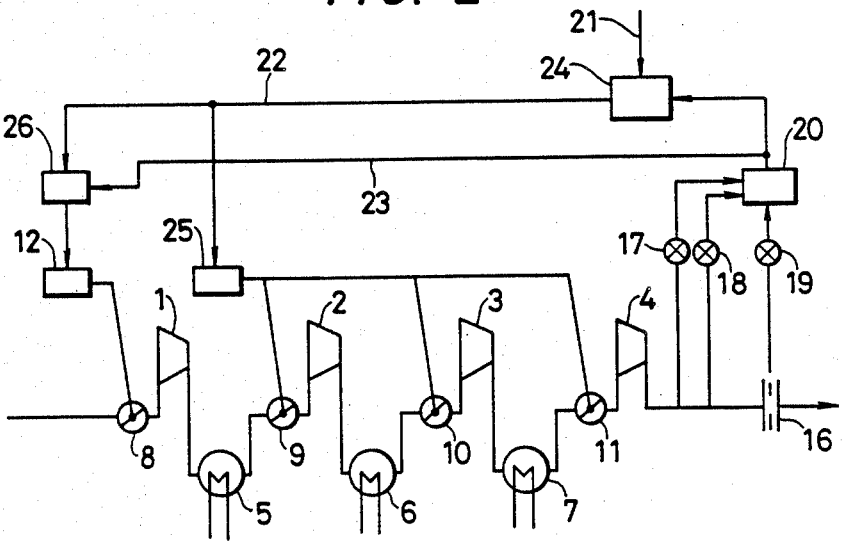
FIGS. 2 to 4 are schematic views of other embodiments of the present invention.
Figure 3:
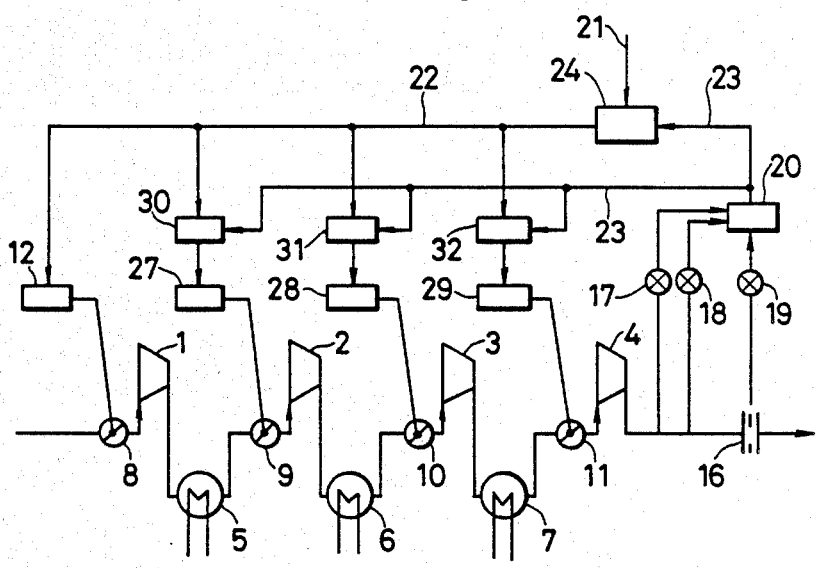
Figure 4:
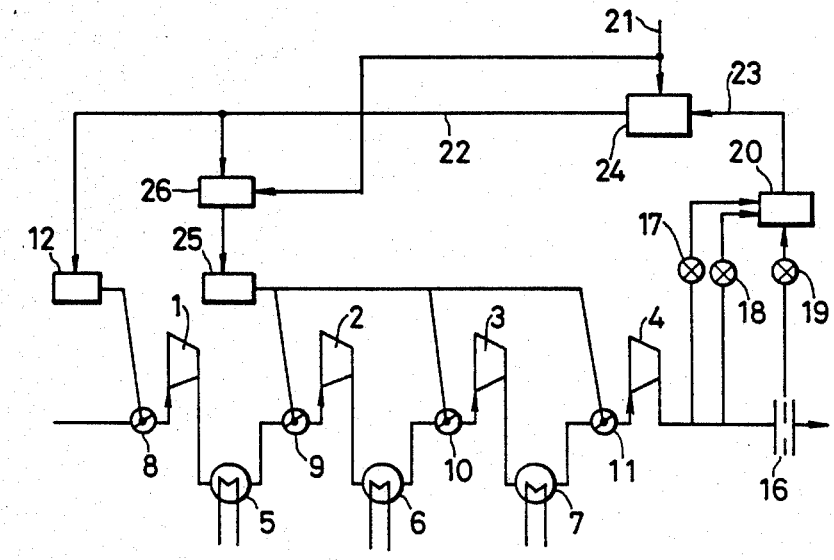
Figure 5:
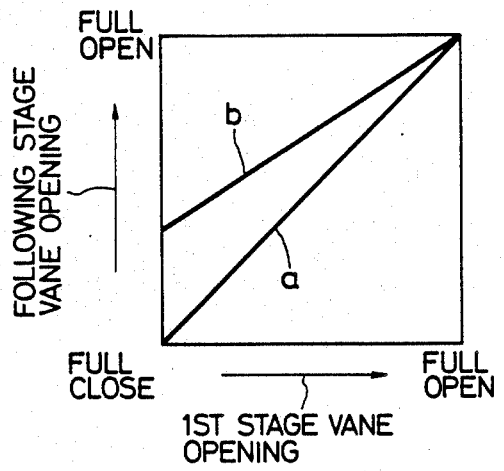
FIG. 5 is a graphical illustration of prior art vane opening relationships.

The description thus far is directed to the construction in which the proportion-setting unit 26 is connected between the controller 24 and the following-stage group vane driver 25; however, as can readily be appreciated, the present invention should not be limited to this construction, and the proportion-setting unit may be connected between the first-stage vane driver 12 and the controller 24, as shown in FIG. 2. Morever, as shown in FIG. 3, according to the present invention, the stages of the following-stage group may be provided with independent vane drivers 27 to 29, and proportion-setting units 30 to 32 connected between each of the; drivers 27–29 and the controller 24. In the description thus far made, still moreover, a method of controlling capacity in terms of metered flow rate has been taken as an example. It is, of course, possible to provide the control by inputting the target flow rate 21 to the proportion-setting unit.

As has been described hereinbefore, the present invention is constructed such that the relationships between the openings of the vanes of the individual stages of the compressor are made to vary in accordance with the flow rate of the multistage compressor. As a result, the present invention can have the effect that the operating range of the multistage compressor can be enlarged, and the fluid performance when partially loaded can be improved.

What is claimed is:

1. A method of controlling a capacity of a multistage compressor, the method comprising the steps of:

providing vanes at entrances of at least two compression stages of the multistage compressor, for controlling an opening of said entrance, comparing a metered flow rate and a target flow rate of said compressor, issuing opening instructions to each of said vanes to control an opening thereof, and varying a relationship between openings of said vanes in accordance with either one of said metered flow rate and said target flow rate.

2. A method of controlling the capacity of a multistage compressor as set forth in claim 1, further comprising the step of dividing said vanes into a plurality of groups so that said opening instructions are provided to groups of vanes.

3. The method of controlling the capacity of a multistage compressor as set forth in claim 2, wherein the step of dividing said vanes includes dividing said vanes into former and following-stages of said multistage compressor.

4. An apparatus for controlling a capacity multistage compressor provided with a plurality of stages, vanes for controlling openings at entrances of at least two compression stages of the multistage compressor, means for issuing opening instructions to each of said vanes after a comparison between a metered flow rate and a target flow rate of said compression for controlling the openings of the vanes, a plurality of drive means for driving said vanes in response to said opening instructions, and proportion-setting means connected to any of said plurality of drive means and responsive to said opening instructions and either one of said metered flow rate and target flow rate to vary relationships between the openings of said vanes in accordance with said received flow rate.

5. The apparatus as set forth in claim 4, wherein said proportion-setting means is adapted to receive either one of said metered flow rate and target flow rate and to output to the other of said drive means a value obtained by multiplying the opening instruction signal of said one of said vanes by a constant and adding a predetermined value to the multiplying value if the flow rate received is higher than an anti-surge capacity of said compressor, or execute an output operation by varying said constant and said predetermined value in proportion to said flow rate if said flow rate is lower than said anti-surge capacity.

6. The apparatus as set forth in claim 4, further comprising intermediate coolers arranged between adjacent pairs of said stages.

7. The apparatus as set forth in claim 4, wherein said multistage compressor includes four stages and a common drive means for driving the vanes of the second to fourth stages thereof.

8. A method of controlling a capacity of a multistage compressor, the method comprising the steps of: providing inlet guide vanes with means for controlling the guide vanes at an inlet of at least two compression stages of a multistage compressor, comparing a metered flow rate and a target flow rate of said compressor, controlling a guide vane angle until a metered flow rate reaches the target flow rate with a tolerance flow rate, and, at above such flow rate, controlling angles of said inlet guide vanes by varying a relationship of vane angles between an optimal inlet guide vane angle in accordance with either said target flow rate or said metered flow rate.

* * * * *